United States Patent [19]

Seabrook

[11] 4,047,616

[45] Sept. 13, 1977

[54] CLOTHES DRIER LATCH

[76] Inventor: Terence Dale Seabrook, 944-956 South Road, Edwardstown, Australia, 5039

[21] Appl. No.: 665,544

[22] Filed: Mar. 10, 1976

[30] Foreign Application Priority Data

Mar. 11, 1975 Australia ..... 867/75

[51] Int. Cl.[2] ..... A47F 5/00; A45B 25/08

[52] U.S. Cl. ..... 211/183; 135/28; 135/38; 135/41; 211/197

[58] Field of Search ..... 135/41, 40, 39, 38, 135/37, 28, 25 R, 4 B, 4 C; 211/183, 197; 248/525, 528

[56] References Cited

U.S. PATENT DOCUMENTS

| | | | |
|---|---|---|---|
| 180,719 | 8/1876 | Kirkham | 135/25 R |
| 273,330 | 3/1883 | Wilson | 135/41 |
| 892,473 | 7/1908 | Walters | 135/37 |
| 1,969,821 | 8/1934 | Saxon et al. | 211/197 |

FOREIGN PATENT DOCUMENTS

| | | | |
|---|---|---|---|
| 1,280,785 | 11/1960 | France | 135/40 |
| 988,557 | 4/1965 | United Kingdom | 211/197 |

*Primary Examiner*—Paul R. Gilliam
*Assistant Examiner*—Kenneth J. Dorner
*Attorney, Agent, or Firm*—Jay L. Chaskin

[57] ABSTRACT

A latch for a clothes drier of the type having a sliding bush with arms pivoted thereto and radiating outwardly therefrom, the latch having a latching tongue with a ramp face which slides over the striker plate as the bush is elevated on a standard and a shoulder which latches the striker plate so as to effect an interlock between the bush and the standard, but when the tongue is depressed away from the striker plate and radially inwardly towards the standard it releases the interlock.

6 Claims, 4 Drawing Figures

CLOTHES DRIER LATCH

This invention relates to a latch which is useful on a clothes drier of the type wherein a sliding member (usually a bush) has a series of arms pivoted thereto radiating outwardly therefrom, the arms being movable from a retracted position with the bush in a downward location, to an extended operative position when the bush is in a relatively elevated location. The invention further relates to a clothes drier bush assembly which incorporates such a latch.

In clothes driers of the type described above, it is considered desirable to incorporate a latch on the sliding bush so that inadvertent retraction of the arms is avoided.

BACKGROUND OF THE INVENTION

One of the difficulties which is encountered with latches of known type is that, being subject to weathering they are likely to become ineffective. For example hinged latch members or sliding latch members are likely to become only partially effective when the working surfaces become covered with dust or corrosive oxides. Thus it is quite probable that a normal type of latch will have the latch member only partially engaging the striker plate, with the result that dislodgement is relatively easy to effect and some hazard may exist. The main object of this invention therefore is to provide improvements whereby the latch is less liable to failure than many previously proposed latches.

BRIEF SUMMARY OF THE INVENTION

In this invention a latching tongue has a ramp face thereon which will slide over a striker plate as a bush is elevated on a standard, and also a shoulder which latches the striker plate to thereby effect an interlock between the bush and standard, the tongue however being deformable away from the striker plate so as to release the interlock. By utilizing a resilient tongue, working parts are avoided and a more positive engagement and release is achieved, than when pivoted members are used.

Specifically, in this invention there is provided a latch useful as a clothes drier of the type wherein one member is slidable over another member, one of the members being a bush having a series of arms pivoted thereto and radiating therefrom, the arms being movable from a retracted position with the bush in a downward location to an extended operative position with the bush in a relative upward location, the latch comprising:

a latching body on one of the members and a striker plate co-operable therewith on the other member, the latching body having a tongue with a ramp face which slides over a sliding surface of the striker plate and thereby effects an interlock between the bush and the standard, when the bush is in said relative upward location, the tongue being of resilient material deformable away from the striker plate to effect interlock release.

Although the latch can be constructed with the striker plate on the bush and the latch body on the standard, it is preferred that the latch body should be on the bush, since construction is thereby simplified.

A further object of the invention is to provide a latch which can be quickly and easily assembled to a clothes drier, so as to reduce assembly costs, and in a further aspect of the invention the latching body comprises a further resilient tongue which co-operates with a further shoulder spaced from one end of the tongue to define a notch, and the bush comprises a web which is engaged in the notch so as to retain the latching body to the bush. Such a latching body may be assembled to a bush by a simple movement in an axial direction. In a further aspect of the invention the latching body may be moulding of polymeric material having resilient properties.

The material from which the latching member is formed must be chosen to have sufficient resilience to ensure firm engagement of the latching shoulder with the latching surface of the striker plate.

BRIEF DESCRIPTION OF THE DRAWINGS

An embodiment of the invention is described hereunder in some detail with reference to and is illustrated in the accompanying drawings in which.

Figure 1:
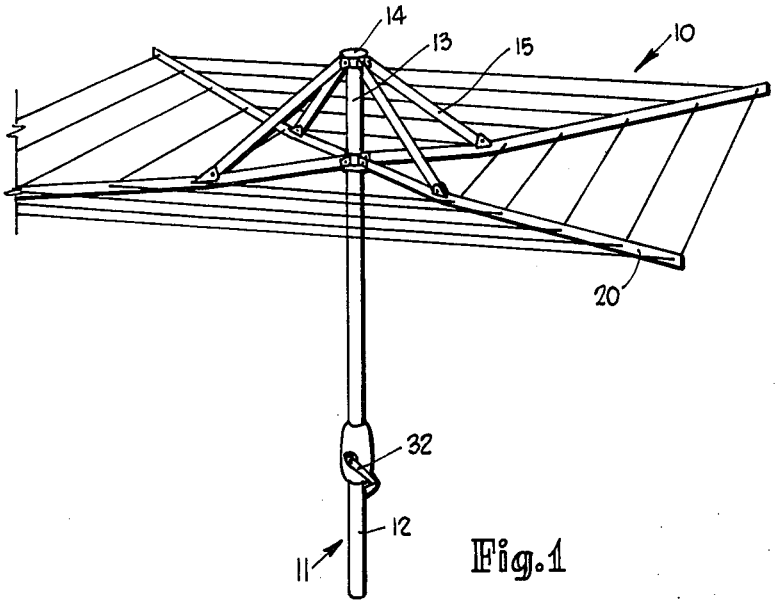
FIG. 1 is a perspective view of a clothes drier.
Figure 2:
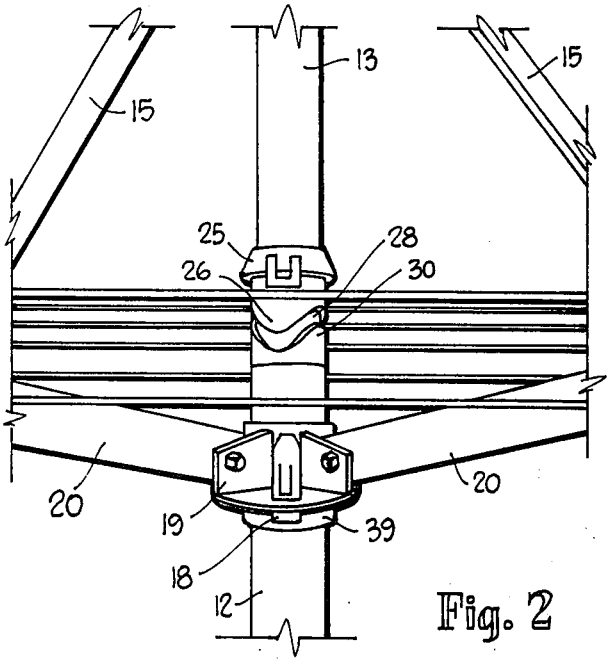
FIG. 2 is a fragmentary elevation which illustrates the latch and bush assembly the subject of this invention.
Figure 4:
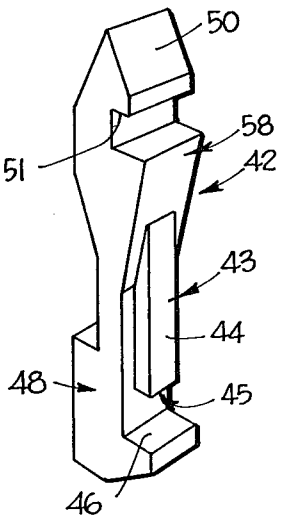
FIG. 4 is a perspective view of the latch body illustrated in the other views.

In this embodiment a clothes drier 10 is provided with a standard generally designated 11 and consisting of a lower fixed standard 12, in which is slidable an upper elevating standard 13 having a cross 14 at its upper end from which a plurality of stays 15 radiate and to which the stays are pivoted.

A sliding bush 18 is slidable over both standards 12 and 13, the sliding bush 18 having four pairs of lugs 19 also constituting a cross (in plan view) to which the inner and lower ends of the drier arms 20 are pivoted by pivot pins 21.

The upper elevating standard 13 has pinned to it by means of a retention pin 24, a latch sleeve 25 which is interposed between the cross 14 on the upper end of the standard and the sliding bush 18. The latch sleeve 25 is provided with a skirt 26 which extends below a flange 27, the lower edge 28 of the skirt 26 being non-planar (in this embodiment of wave formation).

The lower fixed standard 12 contains a bearing bush 29 secured thereto, the upper edge 30 correspondingly being of wave formation, and when the two edges 28 and 30 are contiguous (that is, when the upper elevating standard 13 is in its lowermost position as illustrated in FIG. 1), the assembly of arms, bush, stays and cross can rotate but the wave formation causes sequential lifting of the assembly which snubs rotation. However, when the upper standard is elevated by operation of handle 32 (FIG. 1), the wave formations are separated and the assembly can freely rotate.

Figure 3:
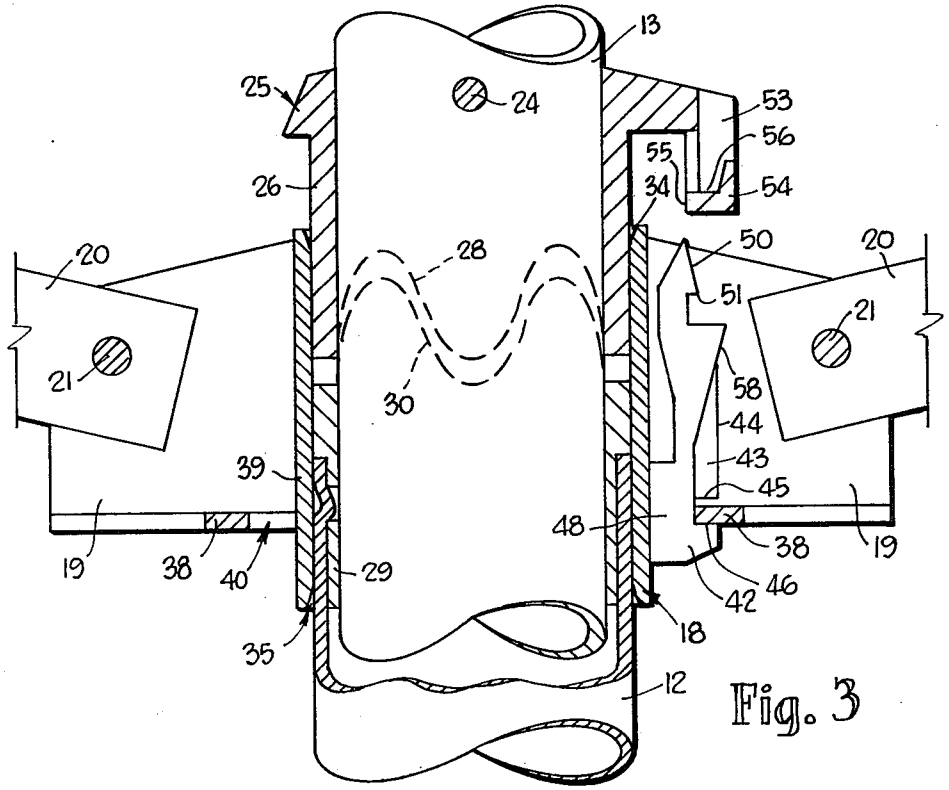
FIG. 3 is a section of same to an enlarged scale.

As shown in FIG. 3, the upper standard 13 is tubular and is guided for elevational and rotational movement by the bush 29. The sliding bush 18 performs an entirely different function however, namely of guiding the inner ends of arms 20 between the retracted and extended positions. Since occasions might arise when it is necessary for the bush 18 to slide over the relatively small diameter upper standard 13, its ends have chamfered mouths designated 34 and 35 to guide it over skirt 26 and lower fixed standard 12 respectively.

The lugs 19 of the sliding bush 18 are arranged in four pairs, the lugs of each pair being spaced from each other but being parallel to each other, the lugs defining, in plan, a cross. Between the adjacent lugs 19 of each adjacent pair of lugs there extends a web 38, and each web is so spaced from the central cylindrical portion 39 of the bush 18 as to form an aperture, designated 40 in FIG. 3.

A latching body 42 is formed from a suitable resilient thermo-plastics material which is moulded to a shape, the shape including a resilient retaining tongue 43 which has a surface 44 enabling the latching body to be positioned through the web aperture by deformation of the material comprised in the tongue, but when the latching body is home in the aperture the lower end surface 45 of the tongue 43 is released so that it engages the upper surface of the web 38, while a retaining shoulder 46 on the latching body 42 engages the under surface of web 38. The lower end of the latching body is provided with a boss 48 which bears against the outer surface of the cylindrical portion 39 of the sliding bush 18.

The boss 48 however bears against the outer surface of the sliding bush 18 for only a short distance, and thereafter the latching body stands away from the bush because of its shape. The outer surface of the latching body 42 at its upper end comprises a ramp face 50 which terminates in a latching 51.

The flange 27 of the latch sleeve 26 is provided with two spaced depending arms 53 which support between them an L-section striker plate 54, having a sliding surface 55 spaced from but facing theouter peripheral surface of the skirt 26 of the latch sleeve 25. The latching surface 56 extends radially away from the striker surface 55.

The configuration is such that when the sliding bush 18 is moved upwardly the ramp face 50 engages the striker plate sliding surface 55 which deflects the latching body until such time body 42 below the latching shoulder 51 is provided with a projecting portion designated 58 which is suitable for pushing against by a finger or thumb or a user to release the latch.

A consideration of the above embodiment will indicate that the invention provides a simple latch devoid of bearings which might stick. The sliding bush latching body and latching sleeve may all be of suitable resilient polymeric material. The latch is released by an inward movement of the latching body towards the standard (this being achieved by the striker plate having its sliding surface displaced from and facing the outer peripheral surface of the latch sleeve, and the striker plate latching surface extending from the sliding surface in a direction away from the sleeve). Since the latching body is provided with a resilient retaining tongue 43 one end of which co-operates with the retaining shoulder 46 to form a notch, assembly to the sliding bush is facilitated.

Various modifications and variations in the embodiment disclosed herein may be made by one skilled in the art without departing from the scope of the invention as defined by the claims.

I claim:

1. A latch useful on a clothes drier of the type wherein one member is slidable over another member, one of the members being a bush having a series of arms pivoted thereto and radiating therefrom, the arms being movable from a retracted position with the bush in a downward location to an extended operative position with the bush in a relative upward location, the latch comprising:

a latching body on one of the members and a striker plate co-operable therewith on the other member, the latching body having a boss, a retaining tongue and a latching tongue with a ramp face and the striker plate having a sliding surface and a latching surface, said ramp face upon upward movement of the bush sliding over the sliding surface, the ramp face terminating in a latching shoulder engageable with said latching surface to thereby effect an interlock between the bush and said another member when the bush is in said relative upward location, the tongues being of resilient material deformable away from the striker plate to effect interlock release and engagement, said latching body also comprising a retaining shoulder spaced from one end surface of the retaining tongue to define a notch, said bush having a web which is engaged in said notch, said boss engaging a surface of said sliding bush when the web is engaged in the notch to thereby retain the latching body to the sliding bush.

2. A latch according to claim 1 further comprising a latch sleeve, means fixing the latch sleeve to the standard, said striker plate being on the sleeve and having its sliding surface displaced from and facing an outer peripheral surface of the sleeve and its latching surface extending from the sliding surface and away from the sleeve.

3. A latch according to claim 1 wherein the latching body is resilient polymeric material.

4. A clothes drier bush assembly comprising a latch sleeve having a depending skirt and a striker plate, said striker plate having a sliding surface and a latching surface, means for securing the latch sleeve to an upper elevating standard of a clothes drier of the type wherein the upper elevating standard is slidable and rotatable in and projects upwardly from a lower fixed standard, a bush having a central cylindrical portion of such dimension that the bush is slidable over both said standards and also over said latch sleeve skirt, and a latching body on said bush co-operable with said striker plate, the latching body having a resilient retaining tongue, a latching tongue with a ramp face which slides over said sliding surface of the striker plate upon upward movement of the bush and terminates in a shoulder engageable with said latching surface and thereby effects an interlock between the bush and the standard when the bush is in said relative upward location, the tongues being of resilient material deformable away from the striker plate to effect interlock release and engagement, said sliding bush comprising a web defining with said central cylindrical portion an aperture, said retaining tongue engaging the web upon insertion of the latching body into the aperture and thereby retaining the latching body to the sliding bush.

5. A clothes drier bush assembly according to claim 4 wherein said striker plate has its sliding surface displaced from and facing an outer peripheral surface of the sleeve and it latching surface extending from the sliding surface and away from the sleeve.

6. A clothes drier bush assembly according to claim 4 further comprising a bearing bush, means securing the bearing bush in the upper end of said fixed standard, said bearing bush comprising an inner bearing surface for rotational and slidable engagement by an outer surface of said upper elevating standard, an upper edge of said bearing bush being of wave formation.

a lower edge of said latch sleeve also being of wave formation co-operable with said bearing bush upper edge to snub rotation of said upper standard when it is in its lowermost position.

* * * * *